US006796248B1

(12) United States Patent
Dressendorfer et al.

(10) Patent No.: US 6,796,248 B1
(45) Date of Patent: Sep. 28, 2004

(54) MODULAR STORAGE CASE AND ADJUSTABLY VARIABLE SHELVING THEREFOR

(76) Inventors: Michael R. Dressendorfer, 352 Rebecca Dr., San Dimas, CA (US) 91733; Maurice L. Heaton, 9 Lake Front, Irvine, CA (US) 92604; Bernard A. Higuera, 14359 Spring Dr., Chino Hills, CA (US) 91709; Gustavo Leon, 7710 Case Ave., Sun Valley, CA (US) 91352; Peter Wilson, 6001 Washington Ave., Whittier, CA (US) 90601

( * ) Notice: Subject to any disclaimer, the term of this patent is extended or adjusted under 35 U.S.C. 154(b) by 0 days.

(21) Appl. No.: 09/828,412

(22) Filed: Apr. 6, 2001

(51) Int. Cl.[7] ..... A47B 9/00
(52) U.S. Cl. ..... 108/110; 108/106
(58) Field of Search ..... 108/110, 107, 108/106, 61; 211/184

(56) References Cited

U.S. PATENT DOCUMENTS

| | | | | |
|---|---|---|---|---|
| 810,545 | A | * | 1/1906 | Krag |
| 1,059,464 | A | * | 4/1913 | Hine |
| 1,723,753 | A | * | 8/1929 | Vance |
| 1,764,131 | A | * | 6/1930 | Walter |
| 1,937,935 | A | * | 12/1933 | Zimmerman |
| 2,953,258 | A | * | 9/1960 | Streit |
| 3,513,983 | A | * | 5/1970 | Kellogg |
| 3,986,616 | A | * | 10/1976 | Gray |
| 4,023,682 | A | * | 5/1977 | Niece |
| 5,127,340 | A | * | 7/1992 | Maro et al. |
| 5,205,420 | A | * | 4/1993 | Petryszak |
| 5,437,380 | A | * | 8/1995 | Peay et al. |
| 5,839,588 | A | * | 11/1998 | Hawkinson |
| 5,957,060 | A | * | 9/1999 | Rosenband |
| 6,116,436 | A | * | 9/2000 | Ferrucci et al. |
| 6,389,991 | B1 | * | 5/2002 | Morrisson |
| 6,460,710 | B1 | * | 10/2002 | Dardashti |
| 6,484,891 | B2 | * | 11/2002 | Burke |

FOREIGN PATENT DOCUMENTS

| | | | |
|---|---|---|---|
| FR | 2638345 | * | 5/1990 |

* cited by examiner

*Primary Examiner*—Jose V. Chen

(57) ABSTRACT

An information module storage case (10) include a plurality of storage shelves (22) of varying spacing to accommodate modules (20) of different dimensions. A shelf base (24) has opposite ends configured for locking receipt within openings in interior sidewalls (16, 18). Channels (30, 32) extend between the base ends and accommodate spring wire end locators (26).

15 Claims, 9 Drawing Sheets

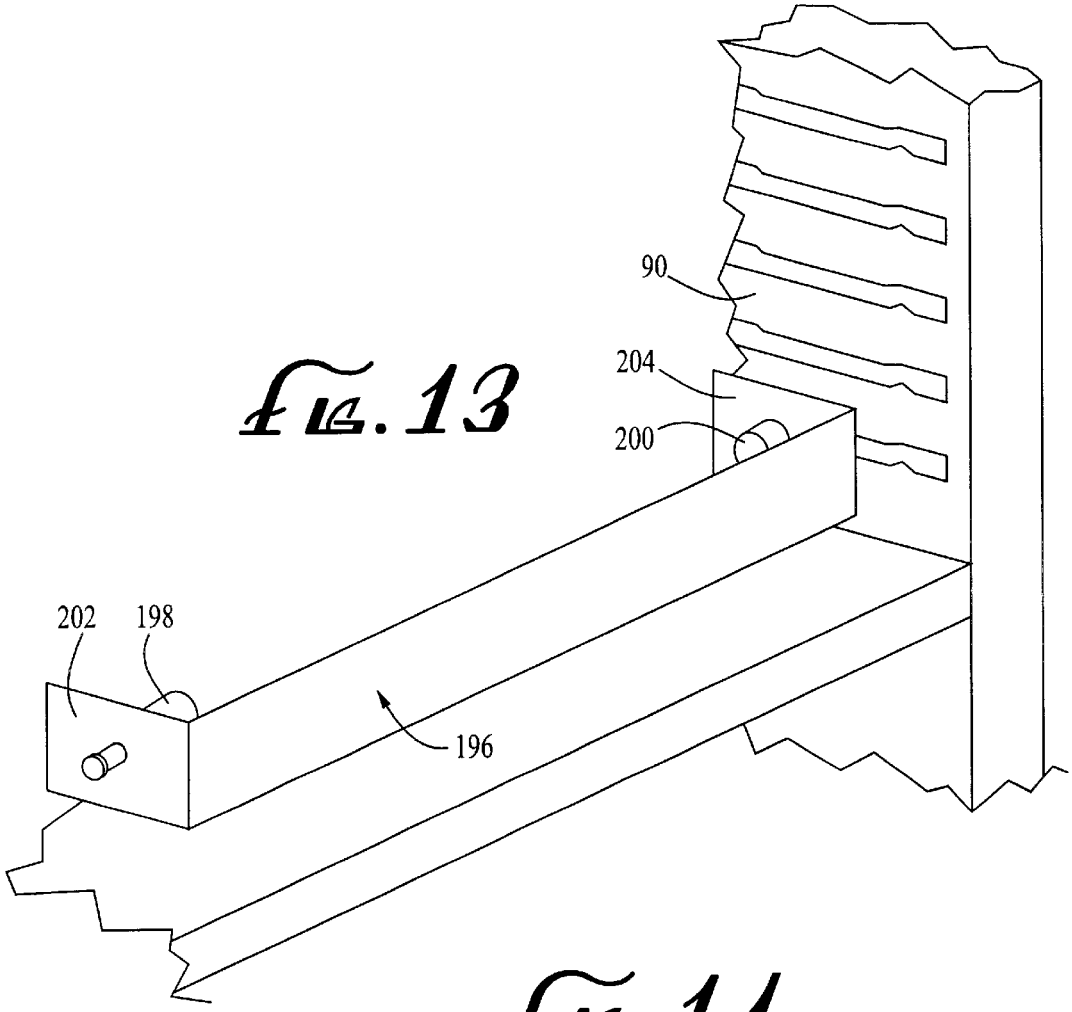
FIG. 13
FIG. 14
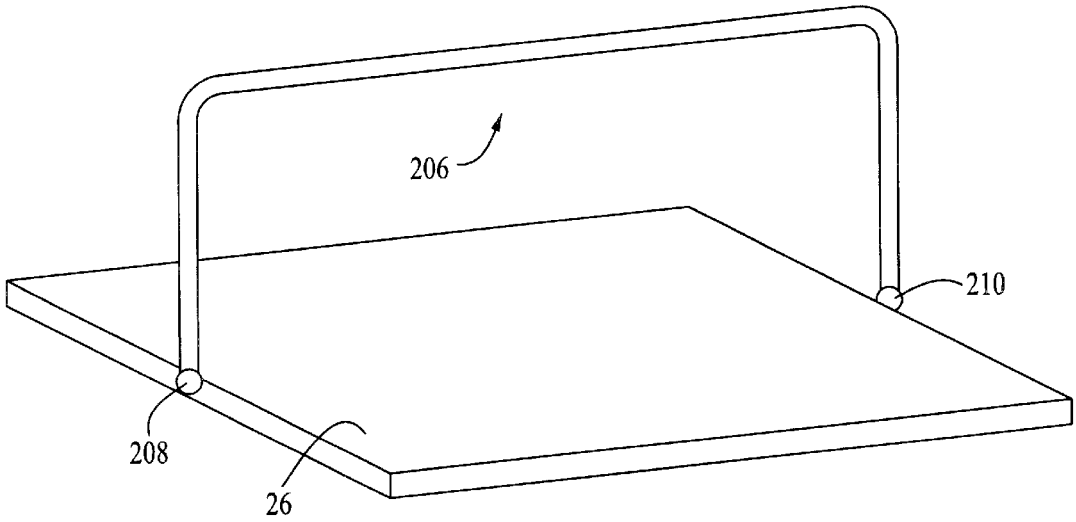

MODULAR STORAGE CASE AND ADJUSTABLY VARIABLE SHELVING THEREFOR

BACKGROUND

1. Field of the Invention

The present invention relates generally to a storage case assembly utilized for storing information modules, with variable shelving releasably and lockingly assembled within the case for accommodating simultaneously information media modules of different sizes.

2. Description of Related Art

Information storage is being accomplished in ever increasing quantities and in a variety of media cartridges of different dimensions (e.g., magnetic and video cartridges for storing wide ranges of data). It is, of course, a given in any business that the density of storage achieved by any storage system should be as high as possible while at the same time provide ready access to individual information stored items.

A well received modular compact storage assembly is that set forth in U.S. Pat. No. 4,657,317, STORAGE ASSEMBLY, which includes storage cabinets containing a number of storage panels or drawers on each of which a plurality of media articles or modules may be supported for storage. More particularly, the storage panels may be slidingly moved from a stored to a withdrawn position with respect to the cabinets, and when in the withdrawn mode enable access for either storing new modules or removing previously stored modules.

Although the patented storage assembly has been found satisfactory, modification of storage cases and shelving to accommodate a wider range of different sized items being stacked together is desirable in that overall handling of customer storage needs is enhanced.

SUMMARY OF THE INVENTION

It is, therefore, a primary feature of the invention to provide an improved information module storage case including a plurality of storage shelves of varying spacing and individually adjustable to accommodate storage modules of different dimensions, which storage case can be individually used, or a plurality of such cases can be mounted for sliding storage within a cabinet and selectively withdrawn therefrom for access to stored items as desired.

Also, in accordance with a shelving embodiment of the invention, a shelving base has two opposite ends configured for releasable locking receipt within openings in interior opposing sidewalls of a case. A pair of channels extending between the base two opposite ends accommodate one or more spring-wire separators having portions received within the shelving base channels to serve as end locators for stored modules. A shelf depth determining means or backstop is adjustably affixed to the shelving base, or to other means, for accommodating variations in module depth dimensions and defining predetermined module depths.

BRIEF DESCRIPTION OF THE DRAWING FIGURES

FIGS. 11 through 14 show further embodiments of back walls.

DETAILED DESCRIPTION OF PREFERRED EMBODIMENTS OF THE INVENTION

Figure 1:
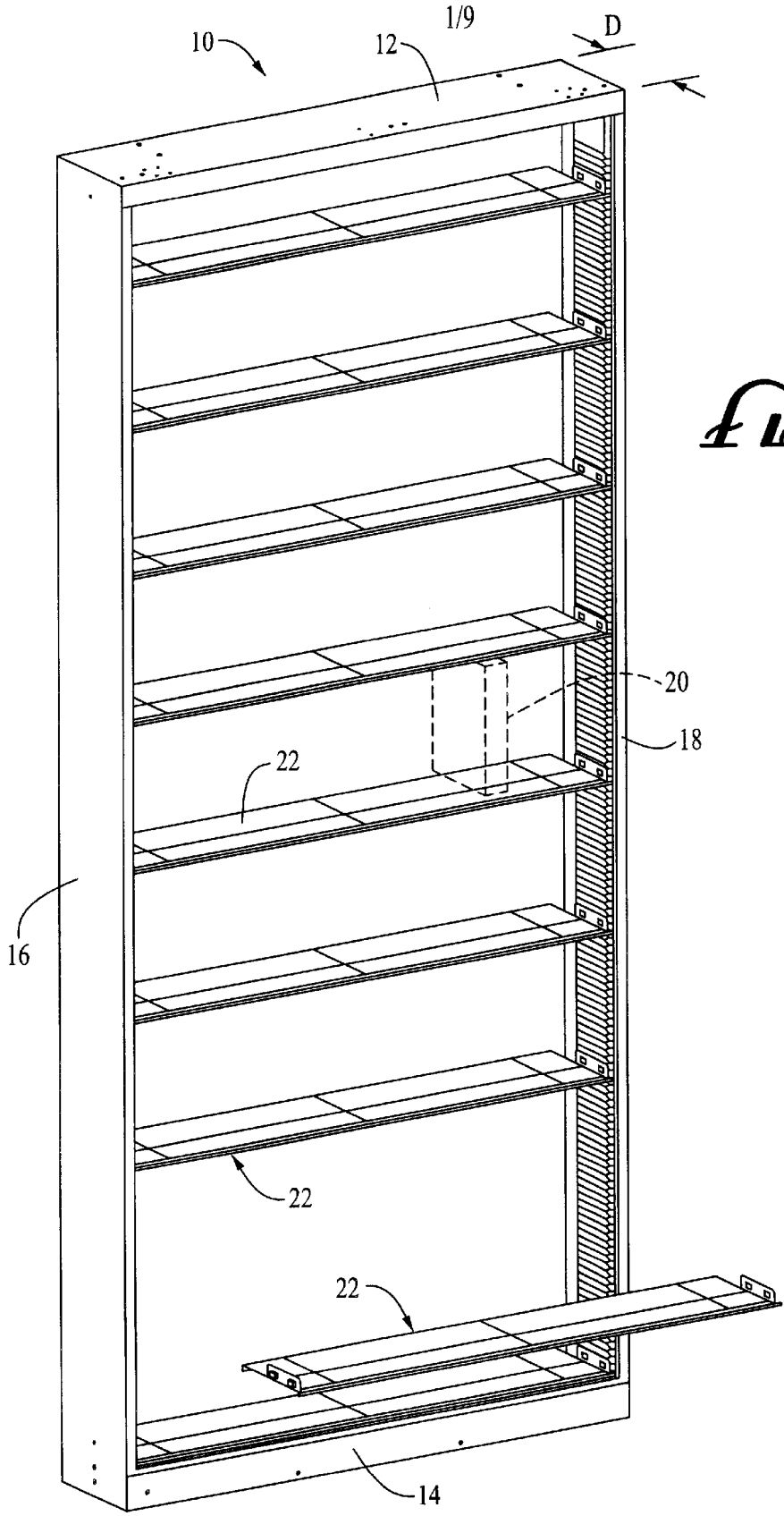
FIG. 1 is a perspective view of a case with a plurality of shelves for storing information modules in accordance with this invention.

With reference now to the drawings and particularly FIG. 1, each shelving case is seen to include an outer support frame consisting of top and bottom members 12 and 14, respectively, and two side members 16 and 18, all end connected into a rigid, unitary generally parallelepiped configuration. It is contemplated that the side members are generally rectangular and with a depth dimension D sufficient to accommodate a stored module 20 entirely within the case containing space defined by the members 12–18. Furthermore, it is contemplated that the case 10 when used will have its bottom member 14 rest upon a horizontal floor surface (not shown) with double-paneled side members 16 and 18 extending vertically upwardly therefrom. Also, as will be described later in detail, a plurality of shelves 22 of preferred construction are assembled at selectively predetermined heights to the side members 16 and 18 providing corresponding horizontal surfaces onto which modules 20 of varying dimensions can be stored.

Figure 2:
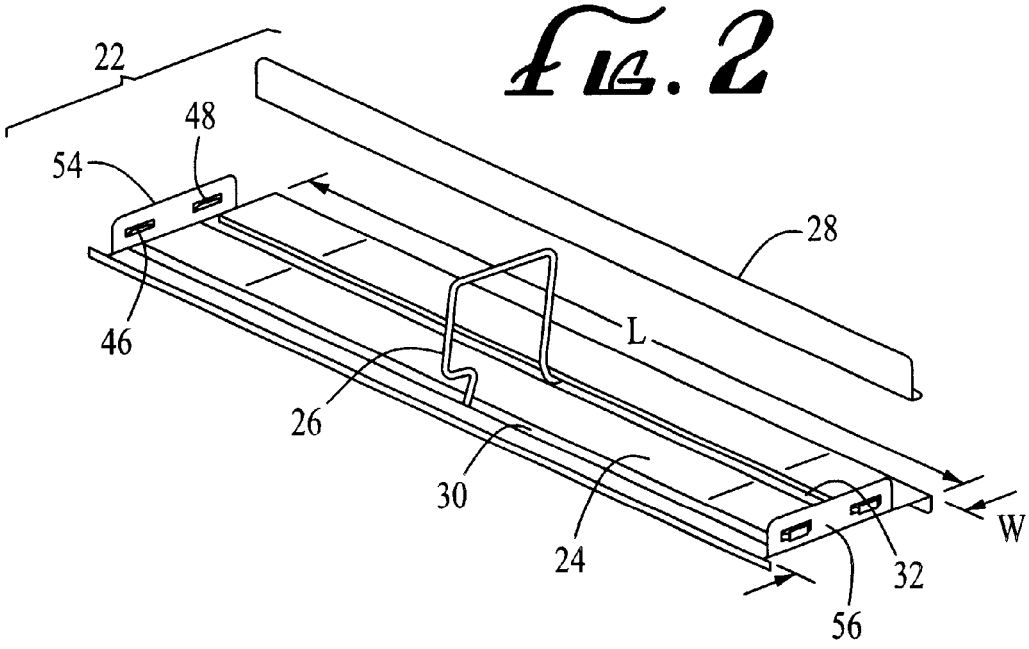
FIG. 2 is a perspective partially fragmentary view of a first shelving embodiment.
Figure 3:
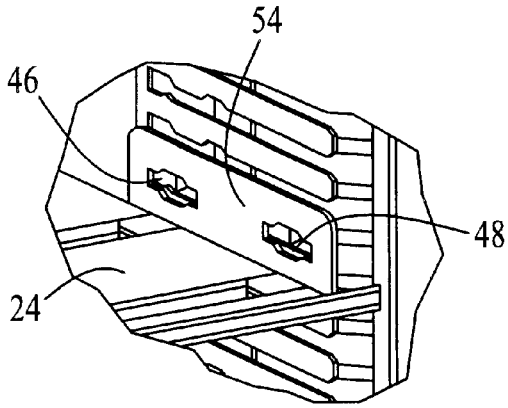
FIG. 3 is an enlarged end detail view of a shelving end connected to a case interior sidewall.
Figure 4:
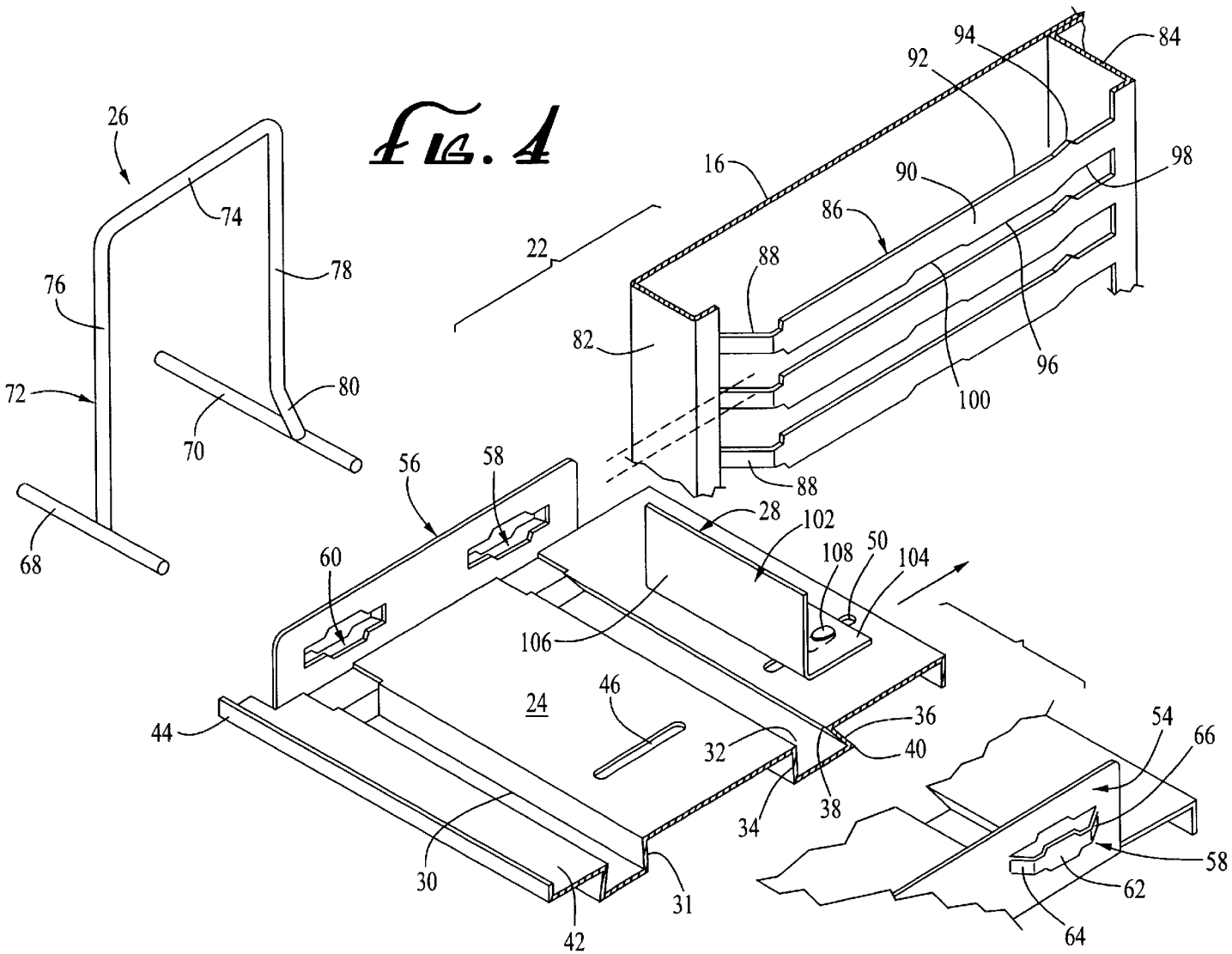
FIG. 4 depicts an enlarged perspective, partially fragmentary exploded view of the shelving embodiment of FIG. 2.
Figure 5:
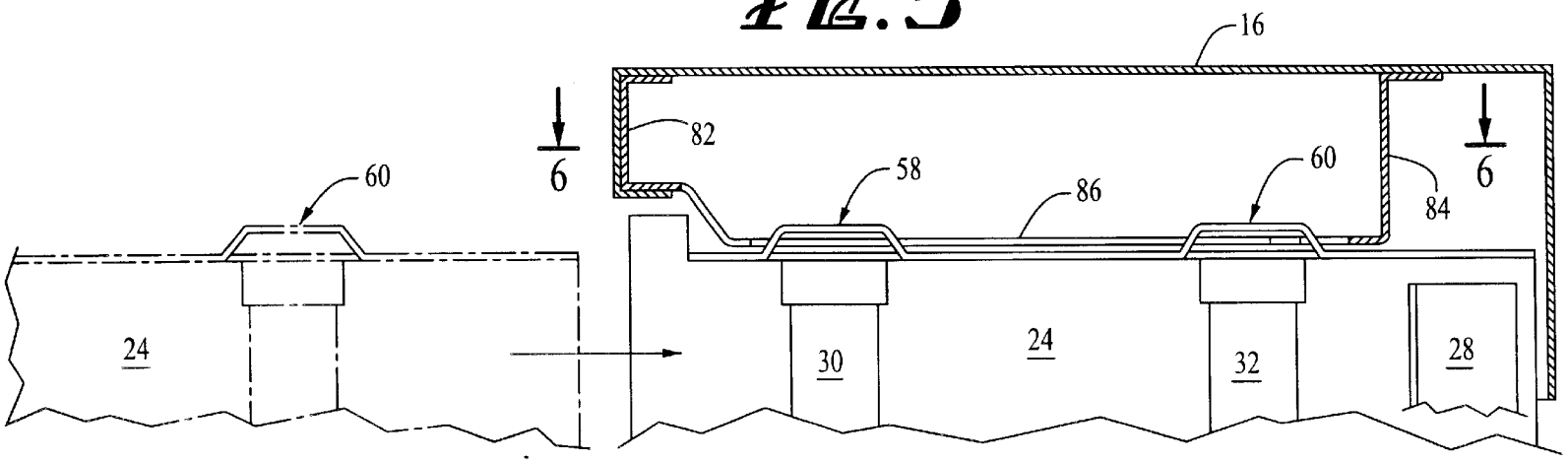
FIGS. 5–8 show detailed sectional views of the shelving during assembly mounting within a case.
Figure 7:
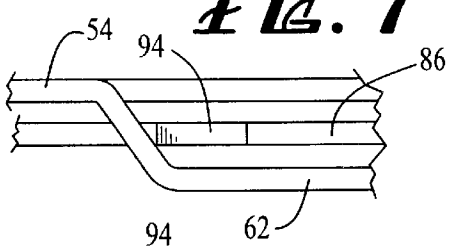
Figure 8:
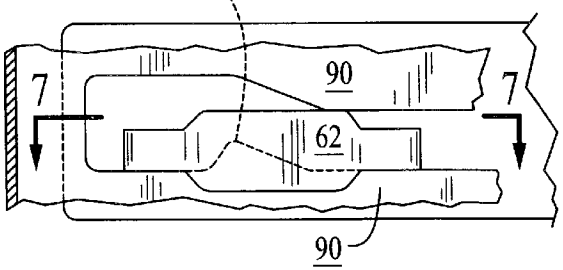
Figure 6:
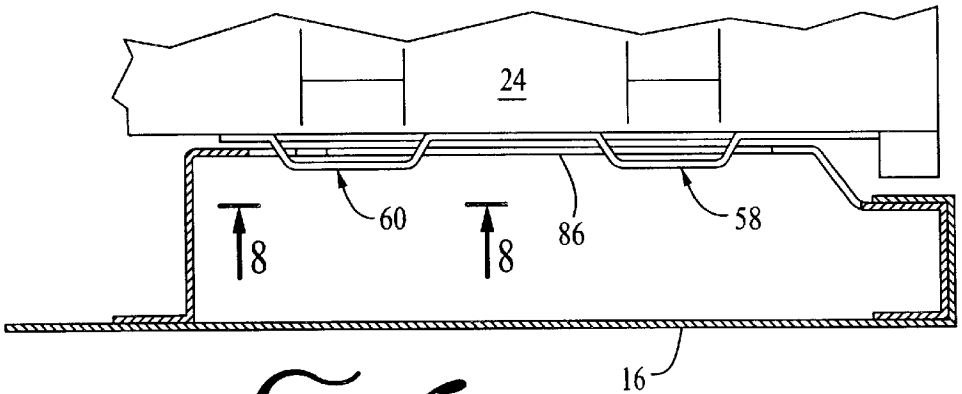

For the ensuing description of a preferred embodiment of shelf or shelving unit enumerated generally as 22, reference is now made especially to FIGS. 2–4 where each shelving unit 22 is seen to include, in its major parts, a shelf base 24, a module stack end support 26, and a module depth wall 28. The base 24 is preferably formed from a single flat, elongated, generally rectangular metal sheet having an overall length L and after processing final width W. First and second channels 30 and 32 are formed in the member extending generally in straight lines parallel to one another along the member long dimension. Both channels open out on the same side of the member which is the top side when assembled. Channel 30 has a generally trapezoidal cross-section with one vertical side wall 31 and one canted sidewall 33 . Similarly, the channel 32 has the sidewall 34 closest to the channel 30 normal to the member major surface plane, while the other sidewall 36 is canted toward the channel 30 with the upper sidewall edge 38 closer to the sidewall 34 than the inner lower edge 40. An edge portion 42 of the base member 24 outwardly of the channel 30 terminates in an upwardly formed lip 44.

A pair of elongated aligned guide slot openings 46 and 48 located adjacent one end of base member 24 are provided in the member, respectively, between channels 30 and 32 and outwardly of the channel 32. More particularly, the guide slot openings 46 and 48 extend orthogonally of channels 30 and 32. Similarly, a second pair of transversely extending slot openings 50 and 52 formed in the member 24 are located adjacent the other end of the member 24. The purpose of the slot openings 46,48 and 50,52 will be described later in connection with the use of the module back stop 28.

Each of the opposite ends of the shelf base 24 is, respectively, formed into a shelf end bracket 54 and 56 extending upwardly on the top side of the base, and since they are identical only the bracket 54 will be described in detail. First and second interconnecting means 58 and 60 are formed on each bracket by bending a cutout portion to desired shape. More particularly, means 58 has a central portion 62 located spaced outwardly from the bracket outer surface with parallel opposite edges and two reduced necks 64 and 66 unitarily relating with the central portion to the bracket. The parallel edges of the central portion of both means 58 and 60 are respectively aligned with each other.

The module stack end support 26 is constructed of rigid wire elements unitarily secured together, or alternatively made from a single piece of wire. In its major parts, the stack end support includes first and second support feet 68 and 70, each of which is a straight-line wire section, respectively secured to the two ends of a generally U-shaped contact frame 72. More particularly, the frame includes a crossbar 74, one straight-line arm 76 and a second arm 78 which is a straight line except for the terminal end portion 80 that is canted away from the arm 76. The frame 72 crossbar and arms lie in the same plane and the support feet interconnected to the frame are parallel to one another. In addition to being rigid, the wire from which the end definer is constructed has spring characteristics enabling it to reassume the design shape after experiencing deformation.

Still referring to FIG. 4, the crossbar dimensions are such that by moderate transverse compression of the frame 72 the support feet 68 and 70 can be inserted, respectively, within the guide channels 30 and 32. Upon releasing the compressive action, the inherent spring characteristics secures the support foot 68 within channel 30 and support foot 70 is secured the channel 32, both feet locked against a canted channel wall thereby snugly positioning the module stack end support at a predetermined position along the channels. Repositioning of the module stack end support, say, to accommodate a change in the number of modules on a shelf, can be accomplished by merely squeezing the support arms toward each other and sliding the unit along the channels, as required.

Figure 9A:
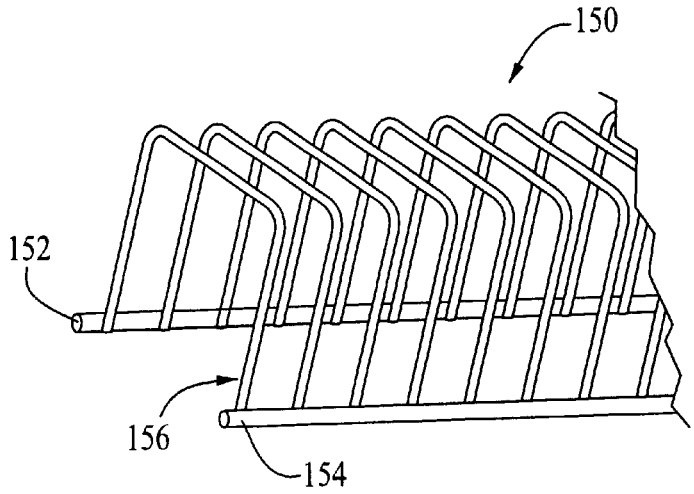
FIGS. 9A and 9B depict an alternative embodiment of a divider for separating a plurality of modules arranged in a row.
Figure 9B:
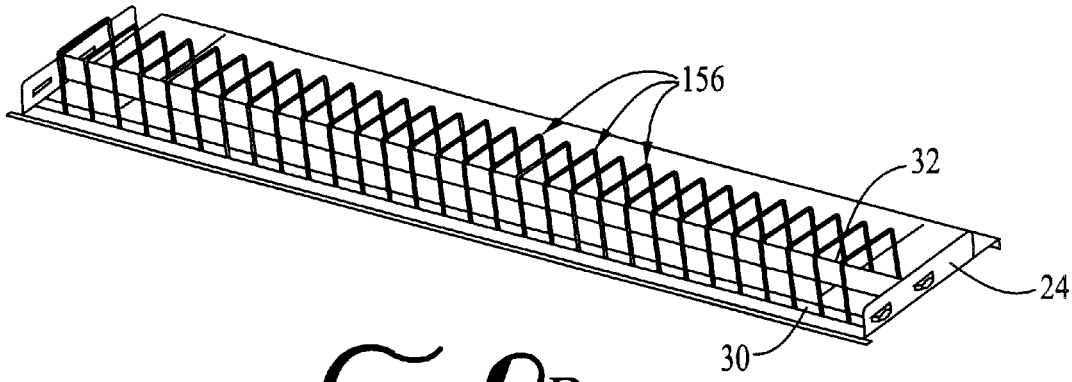

For an alternative embodiment 150 of a stack end support or module organizer particularly adapted to provide a row of individually separated modules, reference is now made to FIGS. 9A and 9B. As shown, the module organized is a unitary bracket assembly including first and second straight-line generally parallel support rods 152 and 154 to which a plurality of preferably uniformly spaced apart separator 156 are secured. Each separator is preferably constructed of a U-shaped wire member the side arms of which have their termini respectively secured to the support rods (e.g., welded), or alternatively the U-shaped members and support rods can be constructed of a single wire. The dimensions of the separators and support rods are such that the support rods 152 and 154 can be securely received within the channels 30 and 32 of a shelf 34, for example, enabling organizing individual modules 20 between adjacent U-shaped wire members.

In use of either stack end support 26 or 150, the support feet are positioned within the channels 30 and 32 below the topmost surface of the base removing them as obstructions to modules being inserting into a module stack or being removed therefrom.

For a shelving unit 22 to be mounted within a shelving case 10, the case side members 16 and 18 have to be modified as will now be described. Each sidewall member includes an outer wall rim panel 82 and inner wall rim panel 84, the latter extending into the case containing space a limited extent. A plurality of specially formed metal strips 86 have opposite ends interconnecting with the rims 82 and 84 and extend generally horizontally therebetween and uniformly spaced apart vertically. Each strip 86 has a first neck portion 88 of reduced width which interconnects with the rim 82 and extends angularly outwardly therefrom. A central portion 90 of the strip is unitary with the neck portion 88 and of greater width, and terminates by interconnecting with inner rim 84. The strip central portion has a generally smooth and straight-line upper edge 92 with a single upwardly projecting cam 94 located spaced from the interconnection with rim 84 a slight amount. The opposite or lower edge 96 of the central portion 90 includes a first shallow concavity 98 located adjacent the rim 84 and a second shallow concavity 100 substantially midway between the two rims. The spacing between the two concavities is substantially the same as the spacing between the interconnecting means 58 and 60 on the shelf end brackets 54 and 56.

As can be seen best by comparison of FIGS. 3 and 4, to mount the shelf base 24 to the case sidewalls 16 and 18, the interconnecting means 58 and 60 at each end of the shelf base 22 are slidingly moved along the space between adjacent neck portions 88 so that the central portions 62 of each interconnecting means is positioned behind the strips 86. This movement is continued until the interconnecting means 58 and 60 are located, respectively, at the concavities 98 and 100, and locked together against inadvertent separation. To remove a fully mounted shelf base 22 from locked engagement with side members 16 and 18, in addition to applying a withdrawing movement opposite to the mounting movement just described, it is necessary to lift the shelving base 24 slightly to overcome the retaining action of the cam 94.

As the name suggests, the module back stop 28 is used to provide a limiting rear wall on the shelf base 24 for maintaining a consistent and uniform front edge of modules stored thereon. The back wall includes a generally L-shaped plate member 102 having a base 104 that is adapted to rest on the upper surface of the shelf base 24, and an integral upstanding wall 106 which in assembled use abuts against the rear edges of modules 20. The base 104 has several openings (not shown), each accommodating a threaded member 108 extending therethrough, and which openings are spaced apart a sufficient amount so that two threaded members 108 extend, respectively, through either paired guide slots 46 and 50, or 48 and 52, depending upon the front to back module spacing required. Since the guide slots are elongated transversely of the shelf base member 24 this provides a considerable amount of depth adjustability for the back wall 28 to accommodate a corresponding amount of variability in the module depth dimensions.

By the practice of the present invention, there is provided an information module shelf in which an edge portion 42 and lip 44 form a front channel groove providing automatic "finger gap" thereby potentially reducing the volume of inactive space and thus increasing the number of shelves and overall vertical capacity of a shelf cabinet.

Figure 10:
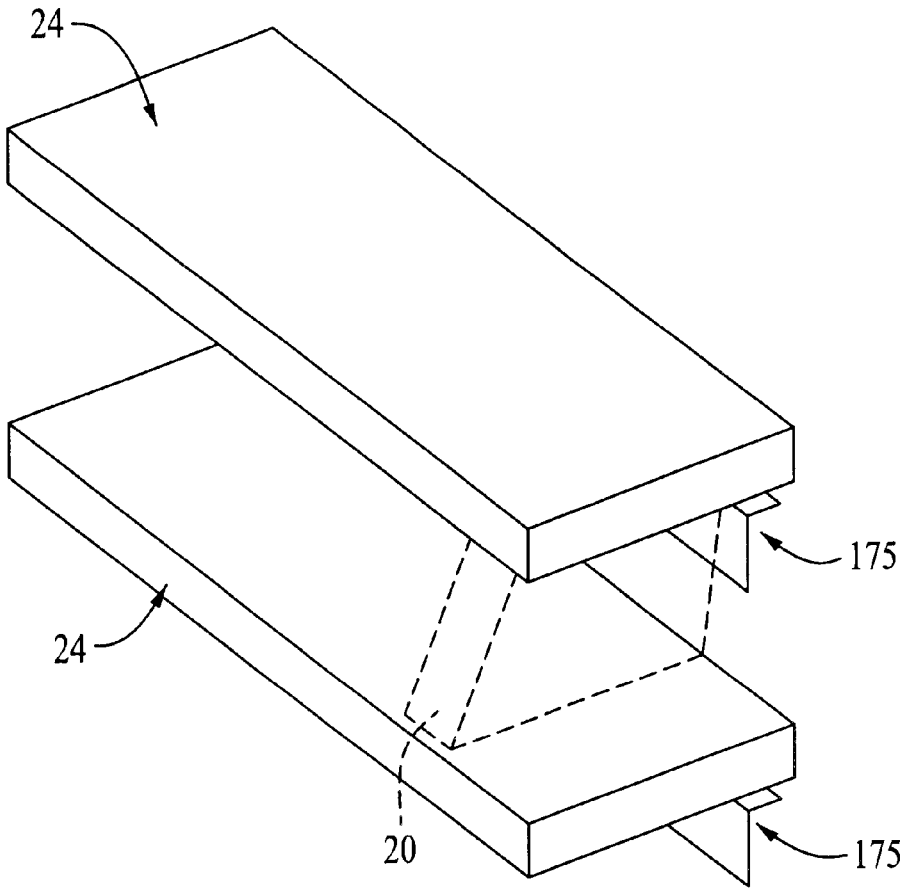
FIG. 10 shows a perspective view of an alternative mounting for a module depth wall.

Turning now to FIG. 10, there is shown an alternative version of a back wall 175, the construction of which can be identical to the L-shaped plate member 102, however, the mounting and manner of use differs. Specifically, the base of the L-shaped member of the back wall 175 is secured to the lower surface of a shelf base 24 using threaded members 108 as in the first described embodiment. In use, the upstanding wall portion of the back wall extends downwardly from the shelf base 24 to which it is mounted toward the next adjacent lower shelf base to provide a rear retaining wall for modules stored on this lower shelf base.

In both of the back wall versions described to this point, the upstanding wall 106 may be located toward the rear of shelf base or turned 180-degrees to locate wall 106 closer to the front edge of the shelf base. This flexibility in mounting provides additional range to the back stop depth dimension.

When a shelving case is constructed as described, it not only provides great flexibility in shelving spacing to accommodate modules of different sizes, but the locked arrangement of the shelves and sidewalls serves to reinforce geometric integrity and prevent any tendency toward bowing of the sidewalls.

Figure 11:
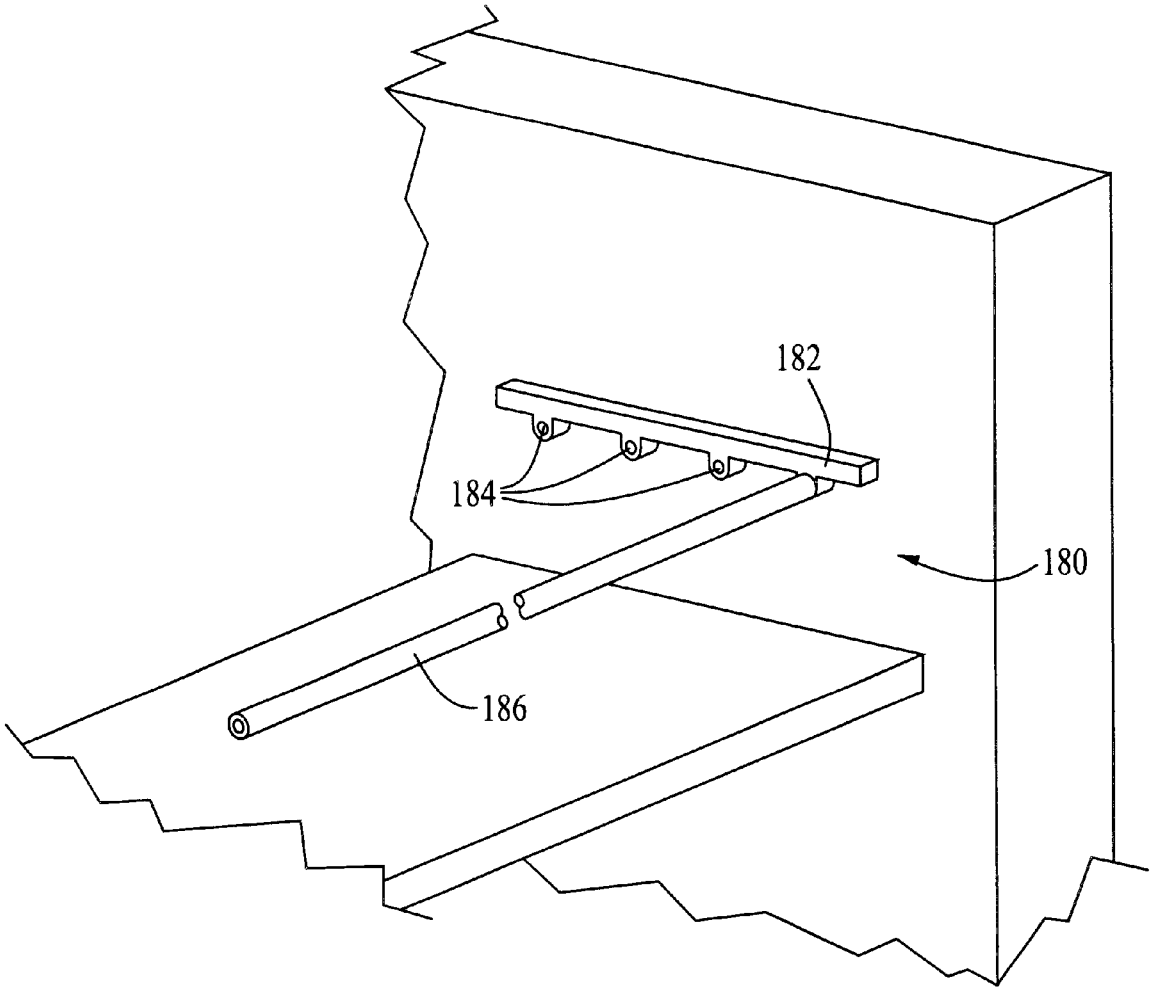

For yet another version of back wall 180, reference is made to FIG. 11 where a bracket 182 secured to the interior surface of a sidewall includes a plurality of hubs 184 spaced apart in a case front-to-back manner. A slightly overlong spacer member 186 with concave ends has one end secured to an appropriate hub and its other end secured to a similar hub mounted to a bracket similar to bracket 182 secured to the other sidewall interior surface of the same case.

Figure 12:
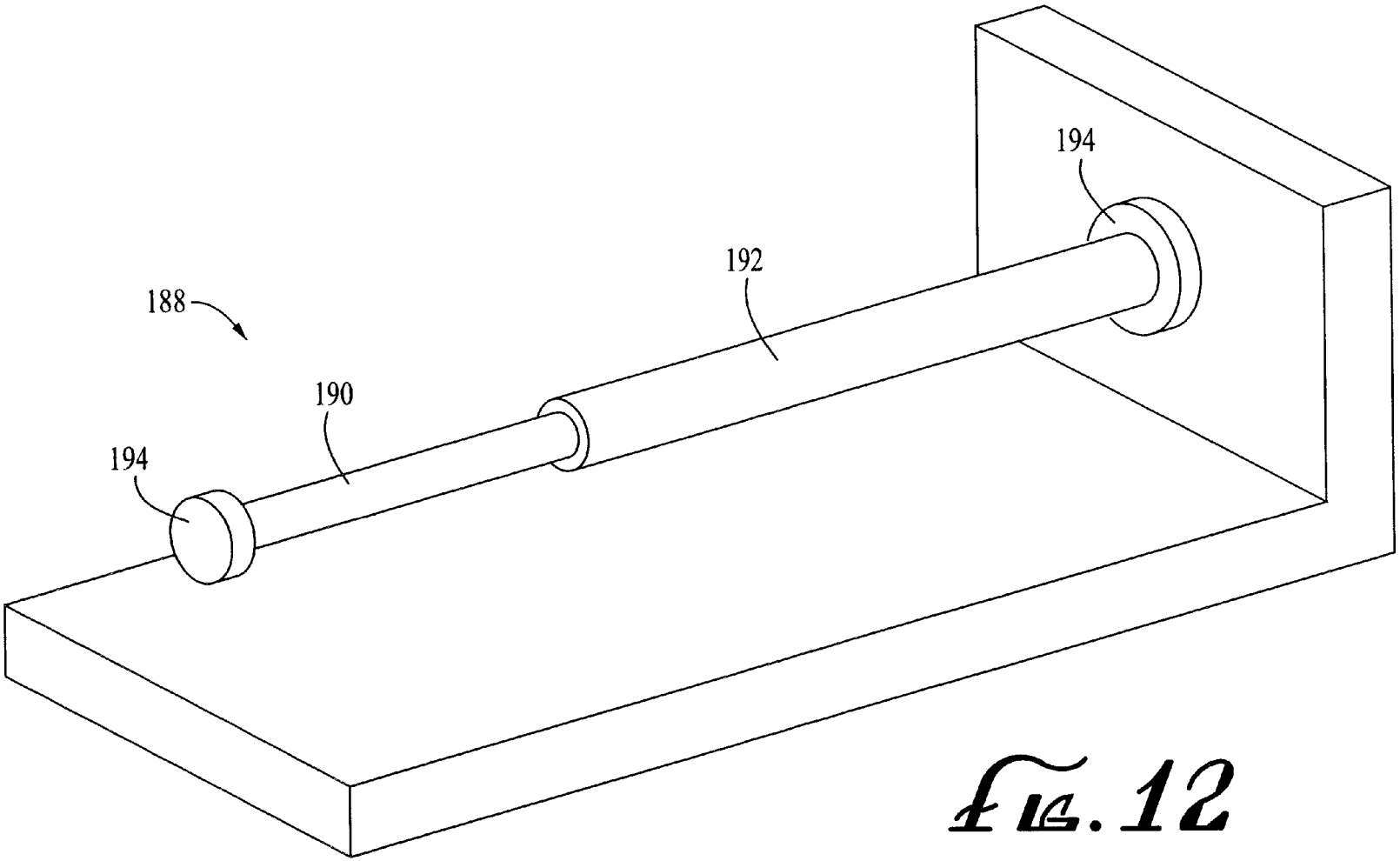

Still another back wall embodiment 188 is depicted in FIG. 12, and is seen to include a pair of telescoping cylinders 190 and 192 interrelated by and internal compression spring. The outer ends of each cylinder include a head 194 which in use is forced against the interior panel of a case sidewall maintaining the cylinders as a form of back wall for a module stack. Instead of an internal spring, the cylinders may be threaded together over a sufficient length to enable mounting between two sidewalls and tightening in place by threading/unthreading the cylinders.

FIG. 13 concerns yet a further embodiment of back stop 196 that includes a generally U-shaped body of length substantially equal to the shelving base length. Threaded members 198 and 200 at each end secure the side arms 202 and 204 to the case interior sidewalls, with necessary adjustment accomplished by sliding along the slots between strips 90.

FIG. 14 is another back stop 206 in which a U-shaped body has the termini 208 and 210 of each arm rotatably mounted to the shelf base. Adjustment is accomplished by rotating the stop 206 about the termini. Position of adjustment is controlled by frictional engagement of the termini and shelf base, for example.

Although the invention has been described in connection with preferred embodiments, it is to be understood that those skilled in the appertaining arts may make modifications that come within the spirit of invention as described and within the ambit of the appended claims.

What is claimed is:

1. A shelving unit for releasable mounting within an upright frame and extending between a pair of spaced apart generally vertical sidewalls, comprising:

each sidewall includes an outside panel, a plurality of vertically spaced apart strips, said strips of the two sidewalls facing toward each other and each space between adjacent strips opening outwardly toward an access side of the frame to provide an entrance to space between the strips and outside panel;

a shelf base of such dimensions as to enable fitting receipt between facing sidewalls of a frame;

first and second mounting shelf end brackets secured respectively to opposite ends of the shelf base including first and second closed spaced apart parallel channels extending about from one mounting shelf end bracket to the other;

infinitely adjustable generally U-shaped spring wire module stack end support having support feet received within the respective channels and positionally held therein by the inherent spring characteristics of the spring wire; and interconnecting means affixed to an outer end surface of each shelf end bracket which is slidingly received through a space opening between adjacent sidewall strips for locking retention of the interconnecting means between the strips and the outside panel.

2. A shelving unit as in claim 1, in which the interconnecting mounts are cut out and integrally formed from the shelf end bracket.

3. A shelving unit as in claim 1, in which an outwardly extending cam on a strip edge engages an interconnecting means preventing inadvertent removal of the interconnecting means from locking retention.

4. A shelving unit as in claim 1, in which the module stack end support feet includes first and second generally cylindrical parallel supports and a generally U-shaped wire member having first and second side arms secured respectively to the cylindrical supports.

5. A shelving unit as in claim 4, in which the first and second channels each have one sidewall canted with respect to the other channel sidewall.

6. A shelving unit as in claim 4, in which there are further provided a plurality of U-shaped wire members having their respective side arms secured to the cylindrical supports in mutually spaced apart relation, adjacent U-shaped wire members forming a module containing space.

7. A shelving unit as in claim 1, in which the shelf base includes an edge portion terminated by an upwardly extending lip at an outer access side of the shelving unit.

8. A shelving unit as in claim 1, in which there is provided a back wall is a generally L-shaped plate having a base side adjustably resting on-the-shelf base and releasably secured thereto.

9. A shelving unit as in claim 8, in which the back wall is a generally L-shaped plate having a base side adjustably resting on the shelf base and releasably secured thereto.

10. A shelving unit as in claim 9, in which the L-shaped plate has an upstanding wall which extends generally vertically upwardly from the shelf base.

11. A shelving unit as in claim 9, in which the L-shaped plate has an upstanding wall which extends vertically downwardly.

12. A shelving unit as in claim 9, in which the base side is secured to the shelf base by releasable securing means.

13. A shelving unit as in claim 8, in which the back wall includes a U-shaped member having its side arms adjustably secured to respective sidewalls of the shelving unit.

14. A shelving unit as in claim 8, in which the back wall includes first and second cylindrical members telescoped onto each other with the outermost ends frictionally engaging the respective shelving unit sidewalls.

15. A shelving unit as in claim 8, in which the back wall includes first and second brackets respectively mounted onto interior surfaces of the case sidewalls, each bracket having a plurality of spaced apart hubs extending inwardly of the case, and a slightly overlong member with a concavity oh each of two opposite ends received onto one hub of each bracket.

* * * * *